US007073790B2

(12) United States Patent
Moffett, VI et al.

(10) Patent No.: US 7,073,790 B2
(45) Date of Patent: Jul. 11, 2006

(54) GAMING DEVICE

(76) Inventors: Nicholas D. Moffett, VI, 1106 Elkhorn Peak La., Spearfish, SD (US) 57783; Emily S. Nelson, 203 W. 20th St., Sioux Falls, SD (US) 57105

( * ) Notice: Subject to any disclaimer, the term of this patent is extended or adjusted under 35 U.S.C. 154(b) by 0 days.

(21) Appl. No.: 11/297,539

(22) Filed: Dec. 8, 2005

(65) Prior Publication Data

US 2006/0087074 A1 Apr. 27, 2006

Related U.S. Application Data

(63) Continuation of application No. 10/800,966, filed on Mar. 16, 2004, which is a continuation-in-part of application No. 09/988,794, filed on Nov. 20, 2001, now abandoned.

(60) Provisional application No. 60/251,427, filed on Dec. 6, 2000.

(51) Int. Cl.
*A63F 7/02* (2006.01)

(52) U.S. Cl. ..... 273/118 R; 273/119 R; 273/138.1

(58) Field of Classification Search ..... 273/118 R, 273/118 A, 118 D, 119 R, 119 A, 121 R, 273/121 A, 138.1, 143 R, 108
See application file for complete search history.

(56) References Cited

U.S. PATENT DOCUMENTS

| | | | | |
|---|---|---|---|---|
| 3,853,318 | A * | 12/1974 | Cagan | 273/379 |
| D251,515 | S | 4/1979 | Richter et al. | |
| D260,409 | S | 8/1981 | Tanaka et al. | |
| 4,508,345 | A * | 4/1985 | Okada | 273/143 R |
| 4,518,098 | A * | 5/1985 | Fleischer | 221/15 |
| 5,010,995 | A * | 4/1991 | Okada | 463/20 |
| D337,790 | S | 7/1993 | Gottlieb et al. | |
| 5,342,049 | A * | 8/1994 | Wichinsky et al. | 273/119 R |
| 5,630,586 | A * | 5/1997 | Lowden | 273/138.2 |
| 5,882,261 | A * | 3/1999 | Adams | 463/20 |
| 5,997,400 | A * | 12/1999 | Seelig et al. | 463/6 |
| D419,201 | S | 1/2000 | de Haas | |
| 6,047,963 | A * | 4/2000 | Pierce et al. | 273/121 B |
| 6,053,813 | A | 4/2000 | Mathis | |
| 6,089,976 | A * | 7/2000 | Schneider et al. | 463/16 |
| 6,089,978 | A * | 7/2000 | Adams | 463/20 |
| 6,203,008 | B1 * | 3/2001 | Krise et al. | 273/121 B |
| 2002/0066996 | A1 | 6/2002 | Nelson et al. | |

FOREIGN PATENT DOCUMENTS

| | | |
|---|---|---|
| GB | 2083936 A | 3/1982 |
| GB | 2182186 A | 5/1987 |
| GB | 2201821 A | 9/1988 |

* cited by examiner

*Primary Examiner*—Raleigh W. Chiu
(74) *Attorney, Agent, or Firm*—Selby & Panka, LLC

(57) ABSTRACT

A gaming apparatus that can be operated by a player in a slot mode and a pinball mode. The apparatus includes a slot machine that can be activated by the player in the slot mode to display different combinations of symbols. The apparatus also includes a pinball machine that can be operated by the player in the pinball mode to play a pinball game. A lever is provided for use with both the slot machine and the pinball machine. The player can manipulate the lever to activate the slot machine when the apparatus is in the slot mode and can manipulate the lever to operate the pinball machine when the apparatus is in the pinball mode.

13 Claims, 3 Drawing Sheets

GAMING DEVICE

CROSS-REFERENCE TO RELATED APPLICATIONS

This application is a continuation of U.S. patent application Ser. No. 10/800,966, titled Gaming Device and filed Mar. 16, 2004, which is a continuation-in-part of U.S. patent application Ser. No. 09/988,794, titled Gaming Device and Method and filed Nov. 20, 2001, now abandoned. U.S. patent application Ser. No. 09/988,794 claims the benefit of U.S. Provisional Patent Application Ser. No. 60/251,427, titled Gaming Device and filed Dec. 6, 2000, now expired. The entire disclosures of each of these applications are hereby incorporated by reference.

BACKGROUND OF THE INVENTION

The present invention generally relates to gaming devices. More specifically, the present invention is drawn to a pinball-slot machine combination.

"Gaming" or the participation of people in wagering games is probably as old as civilization and is worldwide in scope. In the last half of the twentieth century, the proliferation of casinos in the United States alone is evidence that games of chance are still enjoyed by large numbers of people. To maintain and enhance client interest, casino operators are always searching for new and interesting gaming formats. The present invention proposes a new and exciting game, which involves a merger of the widely popular pinball machine and slot machine games.

Variations of pinball gaming devices are shown in U.S. Pat. Nos. Des. 251,515 (Richter et al.), Des. 260,409 (Tanaka et al.), and Des. 337,790 (Gottlieb et al.). These patents merely show ornamental designs of pinball machines.

The most popular gaming device is probably the slot machine, variations of which are disclosed in U.S. Pat. No. 4,508,345 (Okada) and U.S. Pat. No. 5,010,995 (Okada), and in U.K. Patent Application Numbers GB 2,083,936A (Hurst et al.) and GB 2,182,186A (Thomas). These patents show variations of the popular slot machine gaming device.

U.S. Pat. No. 4,518,098 (Fleischer) shows a vending machine designed to appear as a slot machine. U.S. Pat. No. 3,853,318 (Cagan) discloses a combination dart and pinball device.

U.S. Pat. No. 5,630,586 (Lowden), U.S. Pat. No. 5,997,400 (Seelig et al.), U.S. Pat. No. 6,089,976 (Schneider et al.), and U.S. Pat. No. 6,089,978 (Adams) and U.K. Patent Application Number GB 2,201,821A (Pickardt et al.) each disclose combination gaming devices. However, none combine a pinball game and a slot machine game.

U.S. Pat. No. 5,882,261 (Adams) shows a gaming device that incorporates a vertical, pachinko style, pinball-type game with a slot machine. U.S. Pat. No. 5,342,049 (Wichinsky et al.) discloses a pinball-type game combined with a slot machine. These games do not offer interactive pinball play.

None of the above inventions and patents, taken either singly or in combination, are seen to disclose the invention as will subsequently be described and claimed in the instant invention.

SUMMARY OF THE INVENTION

Among the several objects and features of the present invention may be noted the provision of a gaming apparatus that combines a slot machine and a pinball machine in which a single lever allows a player to operate both the slot machine and the pinball machine.

In general, a gaming apparatus of the invention has a slot mode and a pinball mode. The apparatus comprises a slot machine capable of being activated by a player in the slot mode of the apparatus to display different combinations of symbols. The apparatus comprises a pinball machine operable in the pinball mode for the player to play a pinball game. A lever of the apparatus is operable by the player in the slot mode to activate the slot machine and is operable by the player in the pinball mode to play the pinball game.

In another aspect, a gaming apparatus has a slot mode and a pinball mode. The apparatus comprises a slot machine capable of being activated by a player in the slot mode of the apparatus to display different combinations of symbols. The apparatus comprises a pinball machine operable in the pinball mode for the player to play a pinball game. The slot machine includes a lever that is operable by the player in the slot mode to activate the slot machine and is further operable by the player in the pinball mode to play the pinball game.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION

Figure 1:
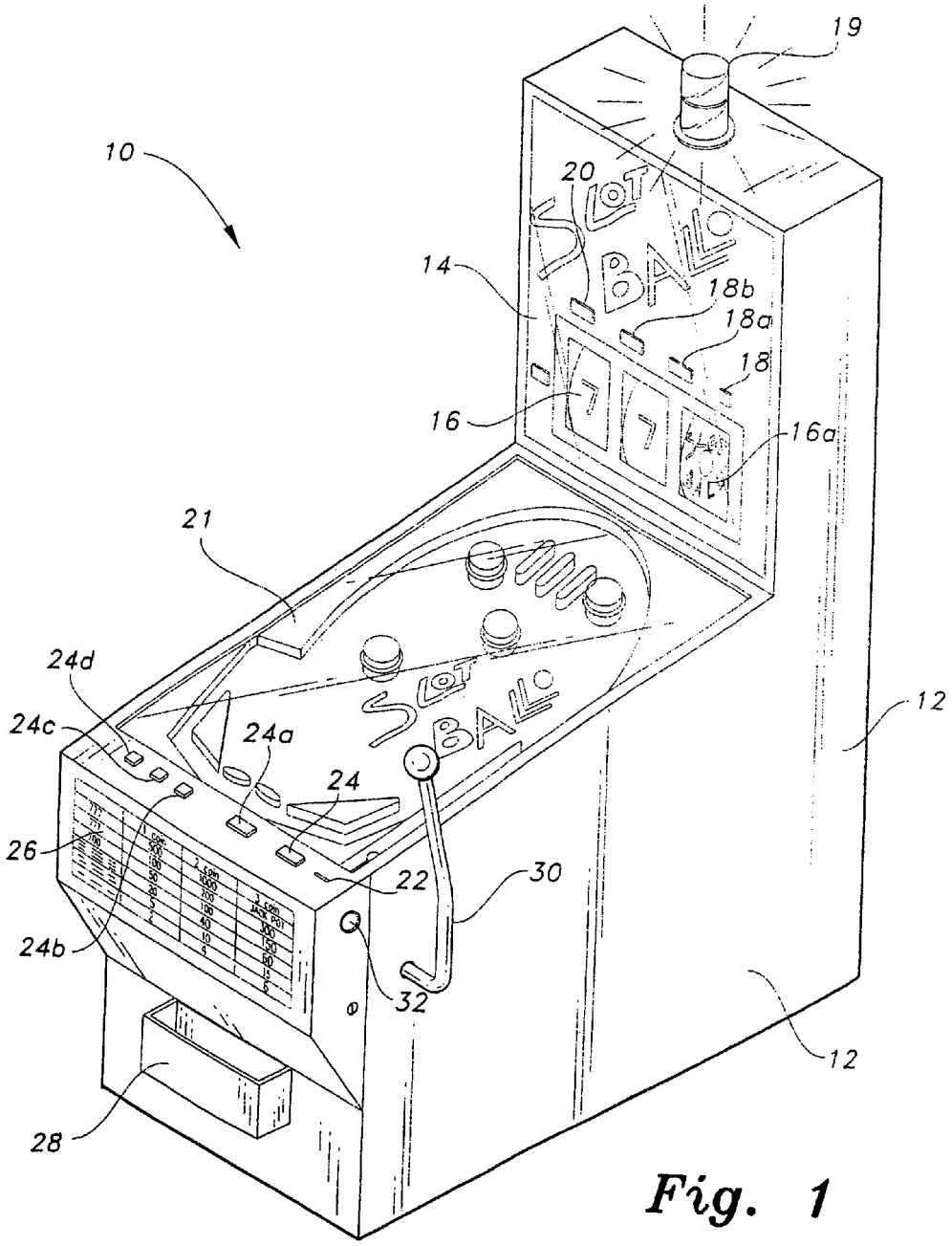
FIG. 1 is a perspective view of a gaming device according to the invention.
Figure 2:
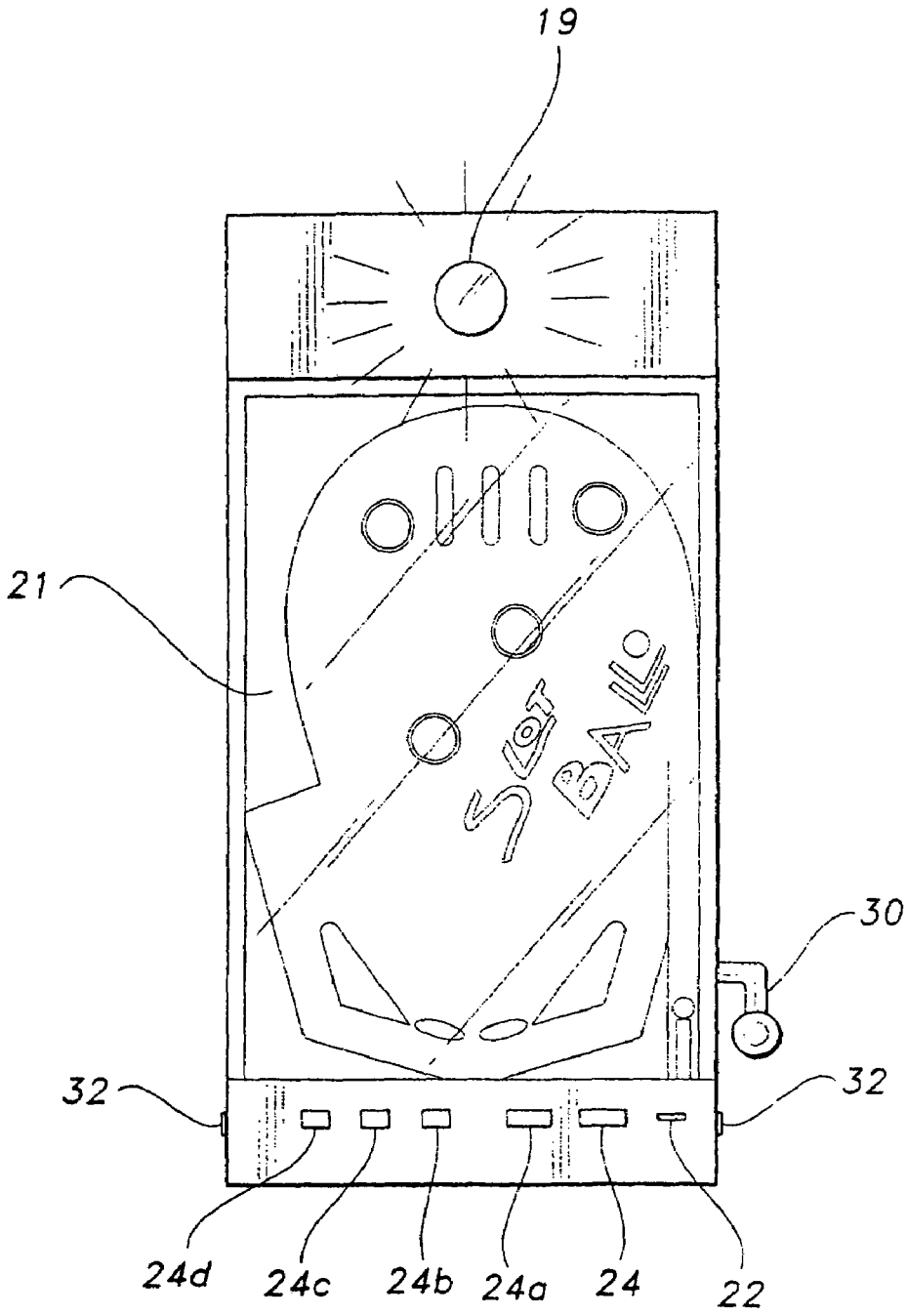
FIG. 2 is a top view of a gaming device according to the invention.
Figure 3:
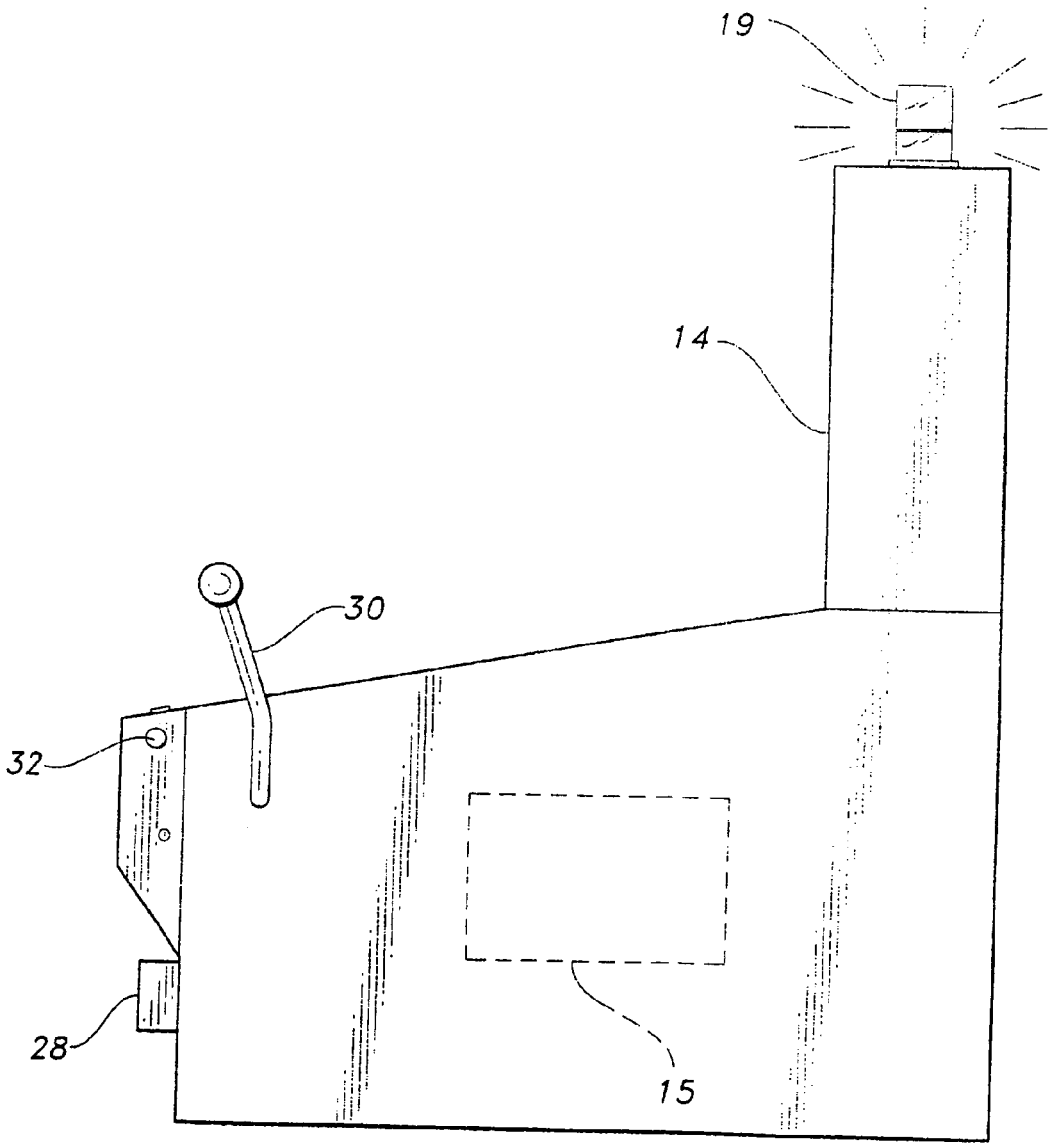
FIG. 3 is a side view of a gaming device according to the invention.

The gaming apparatus of the invention is generally indicated at 10 as illustrated in FIGS. 1–3. Apparatus 10 includes walls 12 which support and house conventional mechanical and electromechanical mechanisms 15 for operating a combination slot-pinball machine game. Walls 12 are designed to form a solid base to prevent the apparatus from being easily tilted. Although walls are illustrated as the support means, it is obvious that sturdy legs (or the like) could be utilized if desired.

The upper section 14 of the gaming apparatus is designed to appear and function as a conventional slot machine and includes slot reels 16 and indicator lights 18, 18*a*, 18*b*. Indicator 18 gives a reading for credits played; 18*a* indicates credits won in the pinball mode; 18*b* indicates total credits available. Indicator light 20 is the winner paid indicator. Slot reels 16 exhibit the standard pay line and slot icons (sevens, bars, cherries, etc.). The instant invention however, requires at least one reel to employ an icon with words, for example "slot ball," inscribed thereon as shown at 16*a*. A light 19 is adapted to flash to indicate either when a machine error occurs or when a player has hit the jackpot.

The lower section 21 of the apparatus is designed to appear and function as a pinball machine. Lower section 21 includes a control panel that incorporates the following functions. A coin slot 22 is provided for inserting coins or casino tokens to initiate the apparatus game mechanisms. Push button 24 is utilized to place a maximum credit bet. Push button 24*a* may be used to activate the slot reels. Button 24*b* is employed when a player wishes to input the amount of credits bet (from one to the maximum amount).

Button 24*c* is used when a player decides to terminate play and wishes to cash out. Button 24*d* is a service button. For convenience, a pay scale 26 is inscribed on the front wall of the apparatus. A tray 28 for catching the player's winnings is positioned immediately beneath the pay scale. A handle 30 may be employed to activate the slot reels or launch the pinball when in pinball mode. Buttons 32 functions to move the pinball flippers (not shown) as is conventional in the art.

To initiate play, the player inserts coins or gaming tokens into coin slot 22. The player may bet any desired amount. However, the player cannot qualify for the slot jackpot and the "slot ball" bonus round if maximum credits are not bet. Handle 30, button 24 or button 24*a* is then manipulated to start slot reels 16. If the "slot ball" icon 16*a* appears on the pay line and the maximum amount of credits have been bet, the machine will automatically switch into the pinball mode. The player will then be able to win extra credits playing pinball. Once the pinball mode is activated, the machine will automatically place a pinball into the launch position. Handle 30 is employed to launch the pinball. As in ordinary pinball games, the player manipulates the pinball by pressing buttons 32, which buttons cause the flippers (not shown) to direct the pinball to strike credit adding or credit subtracting sensors. When the pinball goes out of play, the game reverts to the slot mode. The player has a choice of continuing to play by repeating the above process or to cash out.

In view of the above, it will be seen that the several objects of the invention are achieved and other advantageous results obtained.

When introducing elements of the invention, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense. It is also understood that the invention is not limited to the embodiments described above, but encompasses any and all embodiments within the scope of the following claims.

What is claimed is:

1. A gaming apparatus operable by a player and having a slot mode and a pinball mode, the apparatus comprising:

a slot machine capable of being activated by a player in the slot mode of the apparatus to display different combinations of symbols;

a pinball machine operable in the pinball mode for the player to play a pinball game;

a lever operable by the player in the slot mode to activate the slot machine and operable by the player in the pinball mode to play the pinball game.

2. The gaming apparatus set forth in claim 1 wherein the pinball machine includes a play area and a pinball, the lever being operable by the player in the pinball mode to move the pinball into the play area.

3. The gaming apparatus set forth in claim 2 wherein the slot machine includes a pay line and the slot machine symbols are moveable relative to the pay line, the lever being operable by the player in the slot mode to move the slot machine symbols relative to the pay line.

4. The gaming apparatus set forth in claim 2 wherein the play area of the pinball machine is oriented at an angle greater than zero degrees and less than ninety degrees above horizontal.

5. The gaming apparatus set forth in claim 4 wherein the play area of the pinball machine includes a substantially planar surface, the pinball rolling over the surface of the play area during operation of the pinball machine in the pinball mode.

6. The gaming apparatus set forth in claim 1 wherein the lever is located adjacent the pinball machine.

7. The gaming apparatus set forth in claim 6 wherein the lever is operatively connected to the pinball machine.

8. The gaming apparatus set forth in claim 1 wherein the pinball machine includes a play area, a pinball, a credit adding sensor, a credit subtracting sensor, and a pinball credit score, the lever being operable in the pinball mode to launch the pinball into the play area for engaging the credit sensors to create the pinball credit score.

9. The gaming apparatus set forth in claim 8 wherein the pinball machine includes at least one flipper, the at least one flipper being operable by the player in the pinball mode to interactively move the pinball around the play area to engage the credit sensors.

10. The gaming apparatus set forth in claim 9 wherein the play area of the pinball machine includes a substantially planar surface oriented at an angle greater than zero degrees and less than ninety degrees above horizontal, the pinball rolling over the surface of the play area during operation of the pinball machine in the pinball mode.

11. The gaming apparatus set forth in claim 9 wherein the slot machine includes a slot credit score, the lever being operable in the slot mode to move the slot machine symbols and influence the slot credit score.

12. The gaming apparatus set forth in claim 11 wherein the pinball credit score is added to the slot credit score when the apparatus switches from the pinball mode to the slot mode.

13. A gaming apparatus operable by a player and having a slot mode and a pinball mode, the apparatus comprising:

a slot machine capable of being activated by a player in the slot mode of the apparatus to display different combinations of symbols, the slot machine including a lever;

a pinball machine operable in the pinball mode for the player to play a pinball game;

the lever of the slot machine being operable by the player to activate the slot machine in the slot mode of the apparatus, the lever being further operable by the player to play the pinball game in the pinball mode of the apparatus.

* * * * *